US008256535B2

(12) United States Patent
Hearn et al.

(10) Patent No.: US 8,256,535 B2
(45) Date of Patent: Sep. 4, 2012

(54) MILL-THROUGH TAILPIPE LINER EXIT AND METHOD OF USE THEREOF

(75) Inventors: David D. Hearn, Houston, TX (US); Lamar L. Gantt, Anchorage, AK (US); Howard Gober, Eagle River, AK (US)

(73) Assignee: ConocoPhillips Company, Houston, TX (US)

( * ) Notice: Subject to any disclaimer, the term of this patent is extended or adjusted under 35 U.S.C. 154(b) by 202 days.

(21) Appl. No.: 12/635,353

(22) Filed: Dec. 10, 2009

(65) Prior Publication Data

US 2010/0147592 A1 Jun. 17, 2010

Related U.S. Application Data

(60) Provisional application No. 61/121,789, filed on Dec. 11, 2008.

(51) Int. Cl.
*E21B 7/04* (2006.01)
*E21B 7/08* (2006.01)

(52) U.S. Cl. ..... 175/61; 175/81; 175/62

(58) Field of Classification Search ..... 175/61, 175/81, 62; 166/117.5
See application file for complete search history.

(56) References Cited

U.S. PATENT DOCUMENTS

| | | | | |
|---|---|---|---|---|
| 5,346,017 | A * | 9/1994 | Blount et al. | 166/380 |
| 5,566,757 | A | 10/1996 | Carpenter et al. | |
| 6,047,774 | A | 4/2000 | Allen | |
| 6,138,756 | A * | 10/2000 | Dale | 166/254.2 |
| 6,209,644 | B1 * | 4/2001 | Brunet | 166/297 |
| 6,536,525 | B1 | 3/2003 | Haugen et al. | |
| 6,640,895 | B2 | 11/2003 | Murray | |
| 6,712,144 | B2 * | 3/2004 | Buytaert | 166/313 |
| 7,011,162 | B2 | 3/2006 | Maguire | |
| 7,090,025 | B2 | 8/2006 | Haugen et al. | |
| 7,387,175 | B2 | 6/2008 | Zeer | |
| 2002/0011339 | A1 | 1/2002 | Murray | |

* cited by examiner

*Primary Examiner* — Kenneth L Thompson
*Assistant Examiner* — Cathleen R Hutchins
(74) *Attorney, Agent, or Firm* — ConocoPhillips Company

(57) ABSTRACT

A method and apparatus for forming a window in the wall of a tubular wellbore. In one embodiment described herein, a down hole apparatus for forming a window in the wall of a wellbore utilizing a plurality of tubing string sections and a thick tailpipe positioned at the down hole end of a tubing section.

36 Claims, 2 Drawing Sheets

MILL-THROUGH TAILPIPE LINER EXIT AND METHOD OF USE THEREOF

CROSS-REFERENCE TO RELATED APPLICATIONS

This application claims priority benefit under 35 U.S.C. Section 119(e) to U.S. Provisional Patent Ser. No. 61/121,789 filed on Dec. 11, 2008, the entire disclosure of which is incorporated herein by reference.

FIELD OF THE INVENTION

Embodiments of the present invention relate to a process and a system for drilling sidetrack wells. Specifically, the present invention relates to the drilling of sidetrack wells in existing casing strings which are in close proximity to the packer assembly and/or contain a large constriction ratio.

BACKGROUND OF THE INVENTION

It is well known that hydrocarbons may be produced from subterranean formations through a well that has been drilled into a hydrocarbon bearing formation. Drilling is accomplished by utilizing a drill bit mounted to the end of a drill support member, i.e., a drill string. The drill string is rotated by a top drive, i.e., rotary table, on a surface platform or by a down hole motor mounted towards the lower end of the drill string to facilitate drilling to a desired depth. After reaching the desired depth, the drill string and drill bit are removed, and the wellbore is lined with a string of pipe, i.e., casing. The casing typically extends down the wellbore from the surface of the well to a designated depth. An annular space or annulus, i.e., space between two concentric objects, is formed between the string of casing and the wellbore. The casing string is temporarily fixed or "hung" from the surface of the well. A cementing operation is then conducted in order to fill the annular space with cement. The combination of cement and casing strengthens the wellbore and facilitates the isolation of certain areas of the formation behind the casing for the production of hydrocarbons.

It is common to employ more than one string of casing in a wellbore. In this respect, the well is drilled to a first designated depth with the drill bit on the drill string. The drill string is removed. A first string of casing is run into the wellbore and set in the drilled out portion of the wellbore, and cement is circulated into the annulus behind the casing string. The well is drilled to a second designated depth, and a second string of casing is run into the drilled out portion of the wellbore. The second string is set at a depth such that the upper portion of the second string of casing overlaps the lower portion of the first string of casing. This second casing string is then hung off of the existing casing by slip members and cones to wedgingly fix the second string of casing in the wellbore. The second casing string is then cemented. The process is typically repeated, as necessary with additional casing strings until the well is drilled to the desired depth. As more casing strings are set in the wellbore, the casing strings become progressively smaller in diameter in order to fit within the previous casing string. In this manner, wells are typically formed with two or more strings of casing of an ever-decreasing diameter.

In many circumstances, it is desirable to alter the direction of the wellbore by drilling one or more additional wellbores (often referred to as "laterals" or "sidetracks") outward from the primary wellbore in an effort to increase the productivity of the well or to access additional hydrocarbons in adjacent formations. This can be an effective and economical way to substantially increase the profitability of a well and to increase the overall recovery of fluids from a single, primary well site and surface installation. These lateral wells may extend outwardly from the primary wellbore for substantial distances (e.g., 2000 feet or more) or may be relatively short "drainholes" which extend only a few feet (e.g., 100 feet or less) into the formation. However, the ability to drill precisely on target is a significant challenge when drilling laterals. Drill rigs are expensive and several extra days of rig time may substantially reduce the profitability of drilling additional laterals. Efficiently drilling laterals, which directly and precisely exit the primary wellbore at the desired location within the wellbore first, requires cutting an opening or a window through heavy casing or liner.

A conventional technique for drilling laterals may involve the setting of a kickoff plug, or the like, in a primary wellbore. A kickoff plug may have a length ranging from about 50 to about 500 feet, and may comprise a cement composition. The kickoff plug is typically set in the wellbore by lowering a drill string or open-ended tubing string to the desired depth and pumping a cement composition into the wellbore. The cement composition is allowed to cure and form a plug. After the cement plug has formed, a drill string may be used to reinitiate drilling operations. The drill string and drill bit use the plug to drill in a new direction, so as to thereby deflect the drill string and change the direction in which the drilling proceeds. However, the use of kickoff plugs may be problematic due to the fact that the plug prevents access to further production fluids from lower portions of the original wellbore because the cement seals the well at the deviation.

Another conventional method of forming a lateral wellbore employs a whipstock which is inserted into the main wellbore and fixed therein. The whipstock is typically a steel structure that includes a concave, slanted surface along its upper portion arranged to direct drilling tools coming down the wellbore toward one side thereof. In particular, the whipstock forms a guide for gradually directing a cutting device from the main wellbore of the well into and through the wall of the existing wellbore where the new lateral wellbore will be formed or cut. However, similar to the kickoff plug method, whipstocks are typically permanently installed. A conventional permanently installed whipstock may prevent further access to lower formations below the installed whipstock. Furthermore, wells require some amount of work over to remain productive, which may be prevented to some degree by the installation of a permanent whipstock.

When altering the direction of drilling operations, use of small diameter tailpipes may be desired. It is common practice to mill "dual string" window exits through both the tailpipe and the liner in a single milling operation. However, when the clearance between the tailpipe and the liner approach the diameter of the mill, the mill cannot cut through the liner but rather mills down the annulus potentially trapping the mill. Thus, when the inner diameters of the liner and tailpipe have a "high ratio" approaching 2:1, dual string window exits require separate assemblies and at least two oriented milling runs to mill through the tailpipe and liner even though the inner pipe is well anchored by cement. Additionally, cementing operations utilized in current methods of high ratio window exits severely restrict access to lower formations, requiring expensive and risky operations to gain access to these lower formations.

Therefore, a need exits for a process and a system for completing a well to facilitate a sidetrack operation through a liner.

SUMMARY OF THE INVENTION

In an embodiment of the present invention, a process for drilling a sidetrack wellbore into a desired formation, wherein the process includes: (a) installing a liner within the formation, wherein the liner includes an outer diameter and an inner diameter; (b) installing a tubing string within the formation, wherein the tubing string includes an inner diameter and an outer diameter; (c) installing a tailpipe releasably attached to the tubing string, wherein the tailpipe includes an inner diameter and an outer diameter, wherein the tailpipe is positioned within the liner with the use of millable stabilizing bands, wherein the millable stabilizing bands are connected to the outer diameter of the tailpipe, wherein the outer diameter of the tailpipe is increased until the clearance between the tailpipe and the liner can be safely run into the formation, wherein a diametrical clearance between the tailpipe and the liner is between about ⅛ inch to about ¼ inch, wherein the inner diameter of the tailpipe is larger than the inner diameter of the liner, wherein the tailpipe is fabricated from a durable material capable of being milled; (d) installing a packer assembly, wherein the packer assembly is located along the tubing string and above the tailpipe; (e) installing a whipstock assembly, wherein the whipstock assembly includes an inclined guide surface, wherein the whipstock assembly includes a heel, wherein the tailpipe positions the whipstock assembly near a centerline within the liner, wherein the difference between the inner diameter of the liner and the maximum deviation of the whipstock from the centerline in the formation is minimized to about ½ the value of the diametrical clearance, thereby reducing the distance between the heel of the whipstock to the inner wall of the liner, wherein the whipstock assembly is guided into the formation to a desired location within the tailpipe, wherein the whipstock assembly is then set in place at the desired location within the tailpipe; (f) guiding a milling assembly into the formation through the tailpipe and onto the inclined guide surface of the whipstock assembly, wherein the milling assembly is a straight motor mill; and (g) milling through the tailpipe and the liner in a single milling operation.

In a further embodiment of the present invention, a process for drilling a sidetrack wellbore into a desired formation, wherein the process includes: (a) installing a liner within the formation, wherein the liner includes an outer diameter and an inner diameter; (b) installing a tubing string within the formation, wherein the tubing string includes an inner diameter and an outer diameter; (c) installing a tailpipe releasably attached to the tubing string, wherein the tailpipe includes an inner diameter and an outer diameter, wherein the outer diameter of the tailpipe is increased until the clearance between the tailpipe and the liner can be safely run into the formation; (d) installing a whipstock assembly, wherein the whipstock assembly includes an inclined guide surface, wherein the whipstock assembly includes a heel, wherein the tailpipe positions the whipstock assembly near a centerline within the liner, wherein the difference between the inner diameter of the liner and the maximum deviation of the whipstock from the centerline in the formation is minimized to less than the value of the diametrical clearance, thereby reducing the distance between the heel of the whipstock to the inner wall of the liner, wherein the whipstock assembly is guided into the formation to a desired location within the tailpipe, wherein the whipstock assembly is then set in place at the desired location within the tailpipe; (e) guiding a milling assembly into the formation through the tailpipe and onto the inclined guide surface of the whipstock assembly; and (f) milling through the tailpipe and the liner.

In another embodiment of the present invention, a system for drilling a sidetrack wellbore into a desired formation, wherein the system includes: (a) a liner within the formation, wherein the liner includes an outer diameter and an inner diameter; (b) a tubing string within the formation, wherein the tubing string includes an inner diameter and an outer diameter; (c) a tailpipe releasably attached to the tubing string, wherein the tailpipe includes an inner diameter and an outer diameter, wherein the outer diameter of the tailpipe is increased until the clearance between the tailpipe and the liner can be safely run into the formation; (d) a whipstock assembly, wherein the whipstock assembly includes an inclined guide surface, wherein the whipstock assembly includes a heel, wherein the tailpipe positions the whipstock assembly near a centerline within the liner, wherein the difference between the inner diameter of the liner and the maximum deviation of the whipstock from the centerline is minimized to about ½ the value of the diametrical clearance, thereby reducing the distance between the heel of the whipstock to the inner wall of the liner; and (e) a milling assembly into the formation through the tailpipe and onto the inclined guide surface of the whipstock assembly, wherein the milling assembly mills through the tailpipe and the liner.

BRIEF DESCRIPTION OF THE DRAWINGS

The present invention is shown by way of example and not by way of limitation in the accompanying figures, in which.

DETAILED DESCRIPTION OF THE INVENTION

Figure 1:
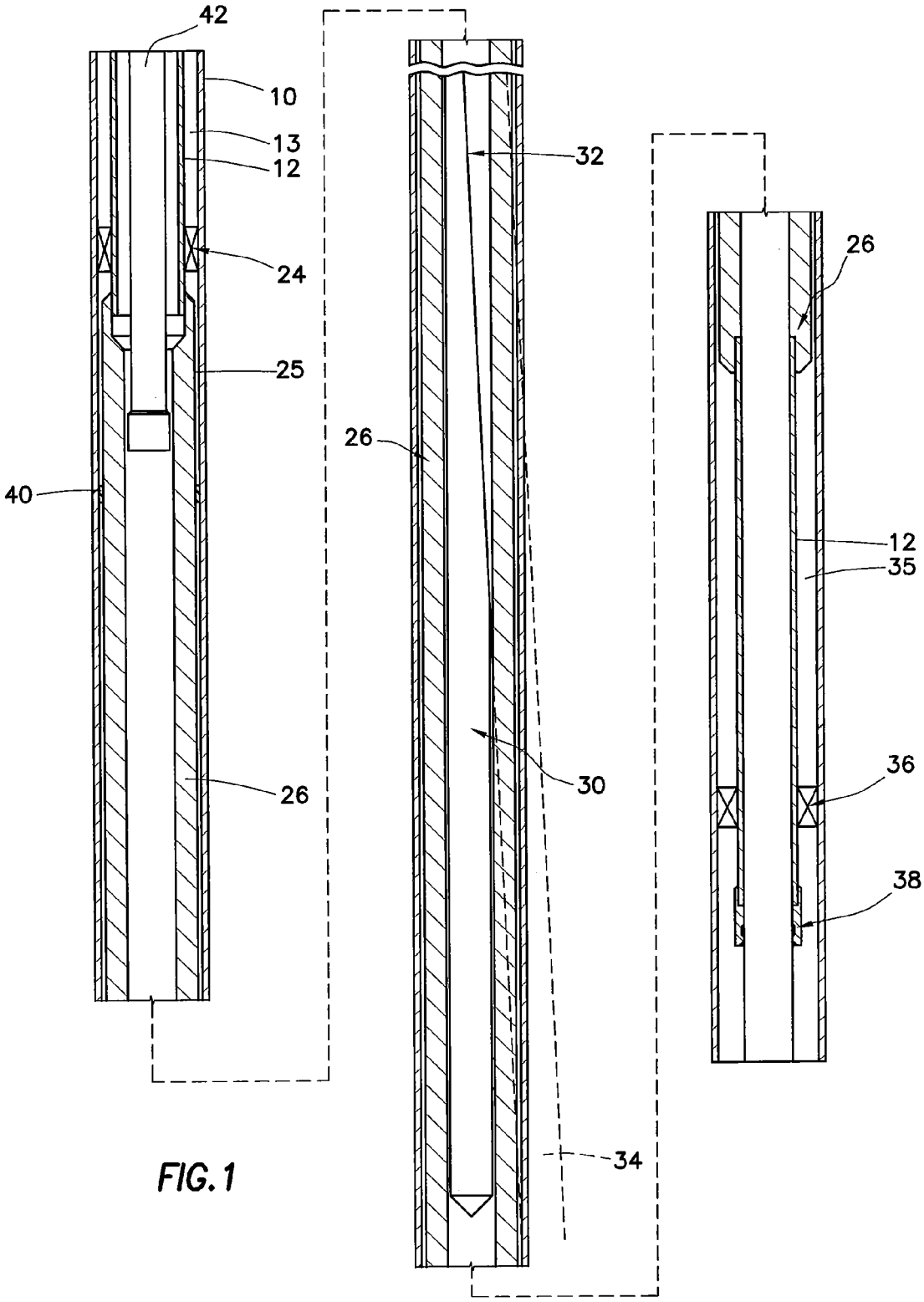
FIG. 1 illustrates a mill through tailpipe liner exit in accord with an embodiment of the present invention.

Reference will now be made in detail to embodiments of the invention, one or more examples of which are illustrated in the accompanying drawings. Each example is provided by way of explanation of the invention, not as a limitation of the invention. It will be apparent to those skilled in the art that various modifications and variations can be made in the present invention without departing from the scope or spirit of the invention. For instances, features illustrated or described as part of one embodiment can be used in another embodiment to yield a still further embodiment. Thus, it is intended that the present invention cover such modifications and variations that come within the scope of the appended claims and their equivalents.

In the description which follows, like parts are marked throughout the specification and drawing with the same reference numerals. The drawing figures are not necessarily to scale and certain features are shown in schematic form or are exaggerated in scale in the interest of clarity and conciseness.

In a conventional drilling operation, a primary wellbore extends into an earth formation for the production of oil and gas. The primary wellbore includes a casing string which is inserted into the wellbore after the wellbore has been drilled. The casing string is generally installed in a wellbore when the well is drilled to target depth or when the sidewalls of the wellbore are in danger of collapsing. If the sidewalls of the wellbore collapse, the wellbore is cased and drilling continues with a smaller drill bit. Once the target is reached, a smaller diameter casing or liner is installed to prevent the sidewalls from collapsing. Typically, once the casing string is installed, cement is forced down the inside of the casing string and up the annulus to seal the casing to the wellbore and prevent fluids from transiting along the wellbore outside of the casing from one formation to another.

A liner 10 is installed within the casing within the primary wellbore. Once a production zone has been reached, a tubing string 12 is installed within the liner 10 to carry hydrocarbons to the surface where such hydrocarbons are recovered and transported to market. Near the down hole end of the tubing string 12, a packer assembly 24 is installed to seal a annular space 13 between the liner 10 and the tubing string 12 in order to prevent fluids from escaping into other parts of the wellbore or formation and to direct the produced fluids into the tubing string 12. Additionally, the packer assembly 24 ensures the fluids do not flow to lower portions of the wellbore.

The packer assembly 24, in the collapsed state, can be inserted into the annulus 13 to a desired location along the length of the tubing string 12. As depicted in FIG. 1, the packer assembly 24 is inserted into the annulus 13 between the tubing string 12 and the liner 10 above the tailpipe 26. In an embodiment, the packer assembly 24 is an inflation type packer assembly and hence uses inflation means for positioning. In another embodiment, the packer assembly 24 is an expansion type packer assembly and hence uses expansion means for positioning.

As depicted in FIG.1, the tubing string 12 is divided into a first section and a second section thus allowing the production tubing string 12 to be interrupted by the installation of a tailpipe 26. At the downhole end of the tailpipe 26, the remaining portion of the tubing string 12, i.e., the second portion of the tubing string, picks back up and continues through the wellbore. FIG. 1 depicts a second packer assembly 36, which is again utilized to ensure fluids do not flow down the liner to lower portions of the wellbore. Likewise, the second packer assembly 36 is inserted, in its collapsed form, into the annulus 35 between the tubing string 12 and the liner 10 at the downhole end of the tailpipe 26. A nipple 38 can be utilized at the end of the second section of the tubing string below the tailpipe.

As previously mentioned, it is sometimes desirable to drill a sidetrack well from within a wellbore. For clarity, it should be understood that conventional wells are drilled substantially vertically from the surface downward to or through the producing formation. However, wellbores may be drilled at a slanted or inclined orientation from the vertical axis. Likewise, deviation may produce a horizontal orientation. Sidetrack wells may extend in any direction from the original well and, in the case of a horizontal wellbore, may extend upward or downward.

The tailpipe 26 assists in formation of a sidetrack wellbore 34. Upon being inserted into the wellbore, below the first section of the tubing string 12 and above the second section of the tubing string 12, the tailpipe 26 is positioned as close to center as practical within the liner 10. In an embodiment, the tailpipe 26 is positioned near center within the liner with the use of millable stabilizing bands 40, which are connected to the outer diameter of the tailpipe. In another embodiment, the tailpipe is positioned within the liner with the use of cement. In another embodiment, the tailpipe is wedgingly positioned in place.

Figure 2:
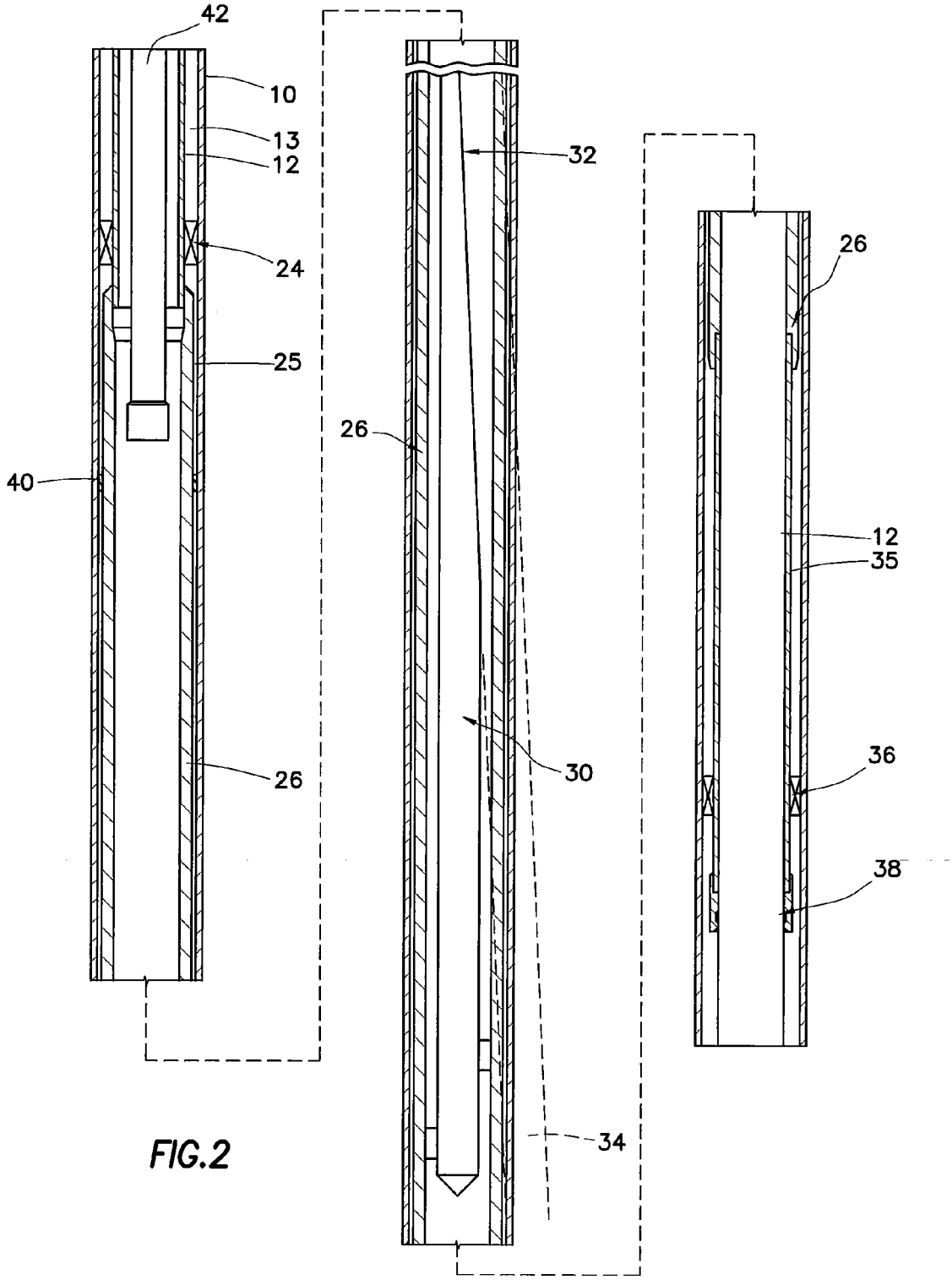
FIG. 2 illustrates a mill through tailpipe liner exit in accord with an embodiment of the present invention.

The tailpipe 26 includes an inner diameter and an outer diameter. The tailpipe 26 guides the whipstock assembly 30 in the liner and minimizes any void space encountered during the drilling operation. Specifically, the outer diameter of the tailpipe is increased until the clearance between the tailpipe and the liner can be safely run into the formation. The diametrical clearance between the tailpipe and the liner is between about ⅛ inch to about ¼ inch. In an embodiment, the inner diameter of the tailpipe 26 is the same as the inner diameter of the tubing string 12. When the inner diameter of the tailpipe 26 is substantially similar to the inner diameter of the tubing string 12, the tailpipe must compensate by either utilizing stabilizing bands or thick walls. A thick wall tailpipe may be utilized to ensure a clearance 25 between the tailpipe and the liner can safely be run into the formation. The thickness of the thick wall tailpipe is determined by the desired inner diameter of the tailpipe and the minimum clearance 25 required to insert the tailpipe into the liner. In another embodiment, the inner diameter of the tailpipe is larger than the inner diameter of the production tubing string 12, as shown in FIG. 2. In yet another embodiment, the inner diameter of the tailpipe 26 is smaller than the inner diameter of the production tubing string 12.

With the tailpipe 26 being in close proximity with the liner wall 10, there is enhanced support for the milling assembly 42 in the annulus 13. Furthermore, the close proximity between the tailpipe 26 and the liner 10 can also potentially eliminate the need for cement thereby allowing the original production below the tailpipe 26. In an embodiment, the tailpipe is fabricated with an easily millable, long-lasting and durable material. In a further embodiment, the tailpipe is made of aluminum, brass, bronze, tin, or lead, or any combinations thereof.

FIG. 1 further depicts a whipstock assembly 30 utilized to assist in the efficient and economical formation of a sidetrack or lateral well. The whipstock assembly includes an inclined surface and a "heel." The whipstock is positioned as close to center as practical within the tailpipe. Specifically, the difference between the inner diameter of the liner and the maximum deviation of the whipstock from a centerline in the formation is minimized to about ½ the value of the diametrical clearance, thereby reducing the distance between the heel of the whipstock to the inner wall of the liner. The positioning of the whipstock within the tailpipe thus minimizes the maximum annular space the mill will encounter, allowing the exit to be cut in a single run with a straight milling assembly requiring no orientation. However, in certain operations it may be desirable to use a bent-motor milling assembly perhaps requiring additional runs.

For demonstrative purposes, and not by way of limitation, the present illustrated embodiments provide a sidetrack well which exits liner 10 to the right. As depicted in FIG. 1, the whipstock assembly 30 includes an inclined whipstock guide surface 32 for positioning the mill in a predetermined location for creating sidetrack wellbore 34. In an embodiment, the whipstock is permanent. In a preferred embodiment, the whipstock assembly is retrievable to allow access to further formations and/or production below the whipstock assembly.

In operation, a mill is guided down the tubing string and through the tailpipe until it reaches the whipstock assembly. Upon contacting the whipstock assembly, the mill is guided via the inclined surface of the whipstock and ultimately forms the sidetrack wellbore. In an embodiment, the mill is a straight motor mill. In another embodiment, the mill is a bent motor mill.

The preferred embodiment of the present invention has been disclosed and illustrated. However, the invention is intended to be as broad as defined in the claims below. Those skilled in the art may be able to study the preferred embodiments and identify other ways to practice the invention that are not exactly as described in the present invention. It is the intent of the inventors that variations and equivalents of the invention are within the scope of the claims below and the description, abstract and drawings not to be used to limit the scope of the invention.

The invention claimed is:

1. A process for drilling a sidetrack wellbore into a desired formation, wherein the process comprises:

a. installing a liner within the formation, wherein the liner includes an outer diameter and an inner diameter;

b. installing a tubing string within the formation, wherein the tubing string includes an inner diameter and an outer diameter, wherein the tubing string is divided into a first section and a second section;

c. installing a tailpipe releasably attached between the first section and the second section of the tubing string, wherein the tailpipe includes an inner diameter and an outer diameter, wherein the tailpipe is positioned within the liner with the use of millable stabilizing bands, wherein the millable stabilizing bands are connected to the outer diameter of the tailpipe, wherein the outer diameter of the tailpipe is increased until the clearance between the tailpipe and the liner is such that the tailpipe can be safely run into the formation, wherein a diametrical clearance between the tailpipe and the liner is between about ⅛ inch to about ¼ inch, wherein the inner diameter of the tailpipe is larger than the inner diameter of the tubing string, wherein the tailpipe is fabricated from a durable material capable of being milled;

d. installing a packer assembly, wherein the packer assembly is located along the tubing string and above the tailpipe;

e. installing a whipstock assembly, wherein the whipstock assembly includes an inclined guide surface, wherein the whipstock assembly includes a heel, wherein the tailpipe positions the whipstock assembly near a centerline within the liner, wherein the difference between the inner diameter of the liner and the maximum deviation of the whipstock from the centerline in the formation is minimized to about ½ the value of the diametrical clearance, thereby reducing the distance between the heel of the whipstock to the inner wall of the liner, wherein the whipstock assembly is guided into the formation to a desired location within the tailpipe, wherein the whipstock assembly is then set in place at the desired location within the tailpipe;

f. guiding a milling assembly into the formation through the tailpipe and onto the inclined guide surface of the whipstock assembly, wherein the milling assembly is a straight motor mill; and g. milling through the tailpipe and the liner in a single milling operation.

2. The process according to claim 1, wherein the tailpipe can be selected from a group consisting of aluminum, brass, bronze, tin or lead, or any combinations thereof.

3. The process according to claim 1, wherein the production packer assembly is an expandable packer or an inflatable packer.

4. The process according to claim 1, wherein the whipstock assembly is a removable whipstock assembly or a permanent whipstock assembly.

5. A process for drilling a sidetrack wellbore into a desired formation, wherein the process comprises:

a. installing a liner within the formation, wherein the liner includes an outer diameter and an inner diameter;

b. installing a tubing string within the formation, wherein the tubing string includes an inner diameter and an outer diameter di ameter, wherein the tubing string is divided into a first section and a second section;

c. installing a tailpipe releasably attached between the first section and the second section of the tubing string, wherein the tailpipe includes an inner diameter and an outer diameter, wherein the outer diameter of the tailpipe is increased until a clearance between the tailpipe and the liner is such that the tailpipe can be safely run into the formation;

d. installing a whipstock assembly, wherein the whipstock assembly includes an inclined guide surface, wherein the whipstock assembly includes a heel, wherein the tailpipe positions the whipstock assembly near a centerline within the liner, wherein the difference between the inner diameter of the liner and the maximum deviation of the whipstock from the centerline in the formation is minimized to less than the value of a diametrical clearance, thereby reducing the distance between the heel of the whipstock to the inner wall of the liner, wherein the whipstock assembly is guided into the formation to a desired location within the tailpipe, wherein the whipstock assembly is then set in place at the desired location within the tailpipe;

e. guiding a milling assembly into the formation through the tailpipe and onto the inclined guide surface of the whipstock assembly; and f. milling through the tailpipe and the liner.

6. The process according to claim 5, wherein the inner diameter of the tailpipe is the same as the inner diameter of the tubing string.

7. The process according to claim 6, wherein the tailpipe is a thick wall tailpipe with a thickness determined by the desired inner diameter of the tailpipe and minimum clearance required to insert the tailpipe into the liner.

8. The process according to claim 7, wherein the clearance required to insert the tailpipe into the liner is between about ⅛ inch to about ¼ inch.

9. The process according to claim 5, wherein the inner diameter of the tailpipe is larger than the inner diameter of the tubing string.

10. The process according to claim 5, wherein the inner diameter of the tailpipe is smaller than the inner diameter of the tubing string.

11. The process according to claim 5, wherein the tailpipe is positioned within the liner with the use of millable stabilizing bands connected to the outer diameter of the tailpipe.

12. The process according to claim 5, wherein the tailpipe is positioned within the liner with the use of cement.

13. The process according to claim 5, wherein the tailpipe is wedgingly positioned within liner.

14. The process according to claim 5, wherein the tailpipe is fabricated from a durable material capable of being milled.

15. The process according to claim 14, wherein the tailpipe is selected from a group consisting of aluminum, brass, bronze, tin, or lead or combinations thereof.

16. The process according to claim 5, wherein the diametrical clearance between the tailpipe and the liner is between about ⅛ inch to about ¼ inch.

17. The process according to claim 5, wherein a packer assembly is installed along the tubing string.

18. The process according to claim 17, wherein the packer assembly is installed above the tailpipe.

19. The process according to claim 5, wherein the packer is an expandable packer or an inflatable packer.

20. The process according to claim 5, wherein the difference between the inner diameter of the liner and the maximum deviation of the whipstock from the centerline in the formation is minimized to about ½ than the value of the diametrical clearance.

21. The process according to claim 5, wherein the whipstock assembly is a removable whipstock assembly or a permanent whipstock assembly.

22. The process according to claim 5, wherein the milling assembly is a straight motor milling assembly or a bent motor milling assembly.

23. A system for drilling a sidetrack wellbore into a desired formation, wherein the system comprises:

a. a liner within the formation, wherein the liner includes an outer diameter and an inner diameter;

b. a tubing string within the formation, wherein the tubing string includes an inner diameter and an outer diameter, wherein the tubing string is divided into a first section and a second section;

c. a tailpipe releasably attached between the first section and the second section of the tubing string, wherein the tailpipe includes an inner diameter and an outer diameter, wherein the outer diameter of the tailpipe is increased until the clearance between the tailpipe and the liner is such that the tailpipe can be safely run into the formation;

d. a whipstock assembly, wherein the whipstock assembly includes an inclined guide surface, wherein the whipstock assembly includes a heel, wherein the tailpipe positions the whipstock assembly near a centerline within the liner, wherein the difference between the inner diameter of the liner and the maximum deviation of the whipstock from the centerline is minimized to less than the value of a diametrical clearance, thereby reducing the distance between the heel of the whipstock to the inner wall of the liner; and e. a milling assembly run into the formation through the tailpipe and onto the inclined guide surface of the whipstock assembly, wherein the milling assembly mills through the tailpipe and the liner.

24. The process according to claim 23, wherein the tailpipe is positioned within the liner with the use of millable stabilizing bands connected to the outer diameter of the tailpipe.

25. The system according to claim 23, wherein the tailpipe is selected from a group consisting of aluminum, brass, bronze, tin, or lead or combinations thereof.

26. The system according to claim 23, wherein a packer assembly is installed along the tubing string.

27. The system according to claim 26, wherein the packer assembly is installed above the tailpipe.

28. The system according to claim 26, wherein a packer in the packer assembly is an expandable packer or an inflatable packer.

29. The system according to claim 23, wherein the inner diameter of the tailpipe is the same as the inner diameter of the tubing string.

30. The system according to claim 29, wherein the tailpipe is a thick wall tailpipe with a thickness determined by the desired inner diameter of the tailpipe and minimum clearance required to insert the tailpipe into the liner.

31. The system according to claim 30, wherein the clearance required to insert the tailpipe into the liner is between about ⅛ inch to ¼ inch.

32. The system according to claim 23, wherein the inner diameter of the tailpipe is larger than the inner diameter of the tubing string.

33. The system according to claim 23, wherein the inner diameter of the tailpipe is smaller than the inner diameter of the tubing string.

34. The system according to claim 23, wherein the tailpipe is positioned within the liner with the use of cement.

35. The system according to claim 23, wherein the tailpipe is wedgingly positioned within liner.

36. The system according to claim 23, wherein the difference between the inner diameter of the liner and the maximum deviation of the whipstock from the centerline in the formation is minimized to about ½ the value of the diametrical clearance.

* * * * *